US010290451B2

(12) United States Patent
Grumel

(10) Patent No.: US 10,290,451 B2
(45) Date of Patent: May 14, 2019

(54) ELECTRICAL SWITCHING DEVICE EQUIPPED WITH MEANS FOR SIGNALING THE PRESENCE OF AUXILIARY BLOCKS

(71) Applicant: Schneider Electric Industries SAS, Rueil-Malmaison (FR)

(72) Inventor: Christophe Grumel, Lans en Vercors (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/967,928

(22) Filed: Dec. 14, 2015

(65) Prior Publication Data

US 2016/0181043 A1 Jun. 23, 2016

(30) Foreign Application Priority Data

Dec. 19, 2014 (FR) ..... 14 63020

(51) Int. Cl.
*H01H 9/16* (2006.01)
*H01H 71/02* (2006.01)
(Continued)

(52) U.S. Cl.
CPC ..... *H01H 71/0264* (2013.01); *H01H 9/0066* (2013.01); *H01H 9/16* (2013.01);
(Continued)

(58) Field of Classification Search
CPC ..... H01H 71/0264; H01H 2071/0278; H01H 71/025; H01H 71/465; H01H 2009/0292; H01H 9/08; H01H 21/04
(Continued)

(56) References Cited

U.S. PATENT DOCUMENTS 3,842,380 A 10/1974 Granson et al.
4,801,906 A 1/1989 Morris et al.
(Continued)

FOREIGN PATENT DOCUMENTS

CN 101933111 A 12/2010
DE 29706429 U1 6/1997
(Continued)

OTHER PUBLICATIONS

French Preliminary Search Report dated Oct. 8, 2015 in French Application 14 63020 filed on Dec. 19, 2014 (with English Translation of Categories of Cited Documents).
(Continued)

*Primary Examiner* — Felix O Figueroa
(74) *Attorney, Agent, or Firm* — Oblon, McClelland, Maier & Neustadt, L.L.P.

(57) ABSTRACT

The electrical switching device comprises an outer enclosure, at least one housing for receiving a removable auxiliary block, the enclosure including a base and a cover, the cover being configured to cooperate with the base to close the outer enclosure.

The cover includes signaling units movable between an inactive position and an active position, and control units configured to move the signaling units from the inactive position toward the active position during closing of the enclosure if at least one auxiliary block is present in a corresponding receiving housing.

9 Claims, 6 Drawing Sheets

(51) Int. Cl.

| | |
|---|---|
| ***H01H 73/12*** | (2006.01) |
| ***H01H 71/04*** | (2006.01) |
| ***H01H 9/00*** | (2006.01) |
| ***H01H 71/46*** | (2006.01) |
| ***H01H 71/08*** | (2006.01) |

(52) U.S. Cl.
CPC ..... *H01H 71/025* (2013.01); *H01H 71/0271* (2013.01); *H01H 71/04* (2013.01); *H01H 71/08* (2013.01); *H01H 71/465* (2013.01); *H01H 73/12* (2013.01)

(58) Field of Classification Search
USPC ..... 200/308
See application file for complete search history.

(56) References Cited

U.S. PATENT DOCUMENTS

| | | | | |
|---|---|---|---|---|
| 5,140,115 | A | 8/1992 | Morris | |
| 5,168,137 | A | 12/1992 | Hufnagel et al. | |
| 5,219,416 | A * | 6/1993 | Rochard | H01H 3/001 200/308 |
| 5,539,168 | A | 7/1996 | Linzenich | |
| 8,610,012 | B2 * | 12/2013 | Liebetruth | H01H 3/30 200/308 |
| 2010/0326802 | A1 | 12/2010 | Scola et al. | |

FOREIGN PATENT DOCUMENTS

| | | |
|---|---|---|
| EP | 0 591 074 A1 | 4/1994 |
| GB | 1 450 564 | 9/1976 |
| JP | 59-101735 | 6/1984 |
| JP | 1-97341 | 4/1989 |

OTHER PUBLICATIONS

Extended European Search Report dated Feb. 24, 2016 in European Patent Application No. 15200987.4 (with English translation of Category of Cited Documents), 8 pages.

* cited by examiner

ELECTRICAL SWITCHING DEVICE EQUIPPED WITH MEANS FOR SIGNALING THE PRESENCE OF AUXILIARY BLOCKS

FIELD OF THE INVENTION

The present invention relates to an electrical switching device including an outer enclosure. The electrical switching device also includes at least one housing for receiving a removable auxiliary block. The outer enclosure includes a base and a cover, the cover being configured to cooperate with the base to close the outer enclosure.

BACKGROUND OF THE INVENTION

Known from document EP 0,591,074 A1 is a circuit breaker comprising an outer enclosure including several housings each able to receive an auxiliary block. Each auxiliary block is then removable relative to the outer enclosure. Each of the receiving housings includes electric terminals able to be connected to an auxiliary block received in the housing. Such a system allows easy customization of the circuit breaker by adding additional functions to it. The function performed by the auxiliary block is for example a signaling function, in which the auxiliary block is able to communicate the state (opened or closed) of the circuit breaker to a remote electronic device.

For safety reasons, it is necessary to prevent access to receiving housings from outside the enclosure under normal operating conditions of the circuit breaker. To that end, the outer enclosure includes a base and a cover able to cooperate to form a closed enclosure surrounding the receiving housings and the auxiliary blocks and to thus electrically isolate them from the outside.

Such a cover also makes the receiving housings and any auxiliary blocks invisible from the outside. The presence of one or more auxiliary blocks in the circuit breaker must be signaled by affixing one or more self-adhesive labels against an outer face of the enclosure of the circuit breaker. These labels bear information relative to the type and/or position of the auxiliary blocks used. The labels are placed, removed, respectively, by the operator during the placement, removal, respectively, of one or more auxiliary blocks.

However, although the placement of self-adhesive labels is a simple operation in itself, it is also a source of errors. It takes great rigor for all of the circuit breakers of a network each to be equipped with labels corresponding to the auxiliary blocks that they include. It is also necessary to update the information on the labels each time the configuration of the auxiliary blocks of the circuit breaker is changed. Furthermore, during the lifetime of a circuit breaker, the labels may be damaged, become illegible or come unstuck. It is therefore often necessary to open the cover of the outer enclosure in order to verify whether the auxiliary blocks are present, and if applicable, what type they are. For safety reasons, such an operation can only be done by an operator authorized to open the enclosure, and often requires shutting off the switching device.

SUMMARY OF THE INVENTION

The aim of the invention is to propose an electric switching device provided with at least one removable auxiliary block, allowing effective and lasting signaling of the presence of one or more auxiliary blocks. The invention also aims to limit the procedures for which the operator customizing the electric switching device is responsible and to minimize the risk of human error.

To that end, the invention relates to an electric switching device of the aforementioned type, wherein the cover includes signaling units movable between an inactive position and an active position, and control units configured to move the signaling units from the inactive position toward the active position during closing of the enclosure if at least one auxiliary block is present in a corresponding receiving housing.

According to other advantageous aspects of the invention, the switching device comprises one or more of the following features, considered alone or according to all technically possible combinations:

- the control units comprise at least one cam configured to cooperate with an auxiliary block present in the corresponding receiving housing and to move the signaling units from the inactive position to the active position during closing of the enclosure, each cam being secured to signaling units;
- the signaling units are translatable relative to the cover;
- the switching device comprises maintaining units configured to keep the signaling units in the inactive position when there is no auxiliary block in the associated receiving housing;
- the signaling units include a signaling member for each receiving housing, and the control units are configured so as, upon closing of the enclosure, to move each signaling member from its inactive position toward its active position if an auxiliary block is present in the receiving housing associated with said signaling member;
- the control units comprise a cam for each receiving housing, each cam being secured to a respective signaling member, and each cam is configured so as, during closing of the enclosure, to move each signaling member from its inactive position toward its active position if an auxiliary block is present in the receiving housing associated with said signaling member;
- the cover includes a viewing window for each receiving housing, each signaling member being, in its inactive position, invisible from outside the enclosure, and in its active position, visible through the viewing window associated with said receiving housing and said signaling member;
- the switching device further comprises a closing off element placed across from each viewing window when the cover is in the closed position, each signaling member being, in its active position, configured to be inserted between the viewing window and the closing off element;
- each signaling member is in the form of a tongue, the cover includes an inner face oriented toward the inside of the enclosure, and the tongue is translatable parallel to said inner face;
- the switching device comprises at least one removable auxiliary block;
- each auxiliary block is an auxiliary contact; and
- the switching device is a circuit breaker.

BRIEF DESCRIPTION OF THE DRAWINGS

These features and advantages of the invention will appear upon reading the following description, provided solely as a non-limiting example, and done in reference to the appended drawings, in which.

DETAILED DESCRIPTION OF PREFERRED EMBODIMENTS

Figure 1:
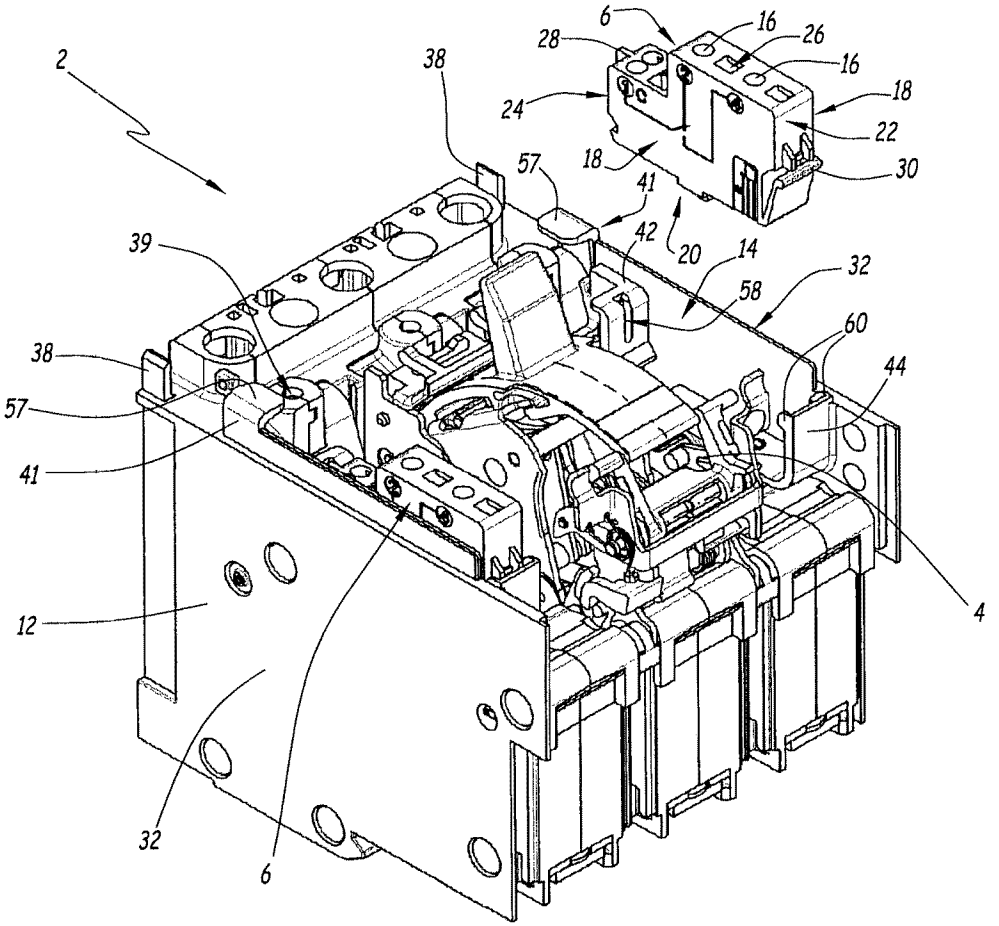
FIG. 1 is a partially exploded view of a switching device according to the invention, comprising an outer enclosure and two removable auxiliary blocks, the outer enclosure including a base and a cover, a switching block including two receiving housings of the two removable auxiliary blocks.
Figure 2:
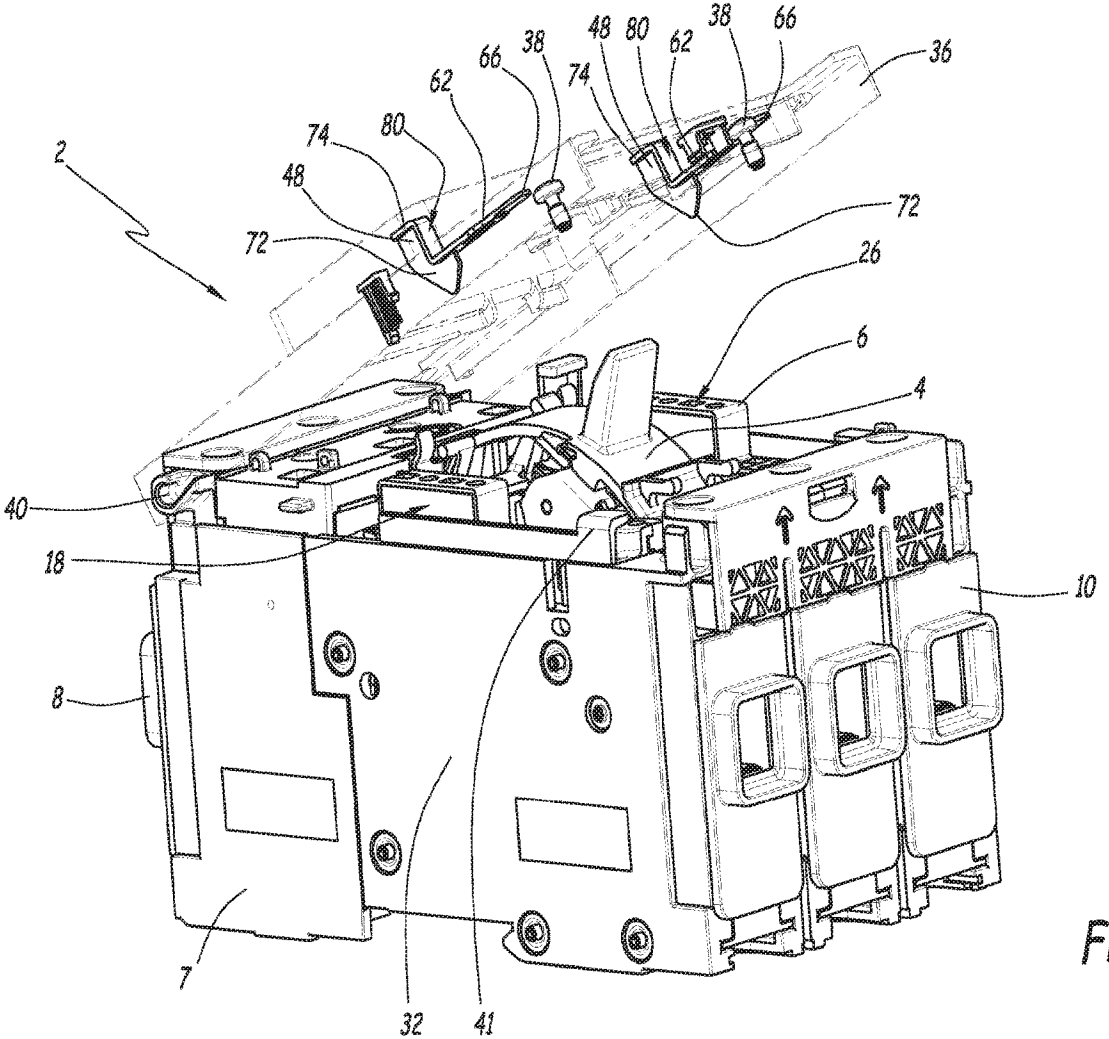
FIG. 2 is a perspective view of the switching device of FIG. 1, wherein the enclosure comprises a base and a cover, the cover being configured to cooperate with the base to close the enclosure and to cover the receiving housings, the cover having outer and inner faces and being provided with two viewing windows.

In FIGS. 1 and 2, the switching device 2 includes a switching block 4, two auxiliary blocks 6 and a trip unit 7, the trip unit 7 being visible only in FIG. 2. In FIG. 2, the switching device 2 also includes input terminals 8, output terminals 10 and an outer enclosure 12.

The switching device 2 is able to receive an input current I on the input terminals 8 and to deliver it on the output terminals 10, and vice versa. In FIG. 1, the switching device 2 is a three-phase circuit breaker.

The switching block 4 comprises at least one auxiliary block receiving housing 14, each receiving housing 14 being configured to receive a respective auxiliary block 6. In the described example embodiment, the switching block 4 comprises two receiving housings 14. The switching block 4 is able to cut the transmission of the input current I between the input terminals 8 and the output terminals 10.

The switching block 4 is known in itself. The switching block 4 is for example an electromechanical switching block.

In the example of FIG. 1, the auxiliary blocks 6 include auxiliary terminals 16, side faces 18, a mechanical actuating face 20, a first end face 22, a second end face 24 and a connecting face 26 bearing the auxiliary terminals 16.

In FIG. 1, each auxiliary block 6 bears a guide rib 28 in the housing 14 and fastening units 30 in the housing 14.

In the example of FIG. 1, the auxiliary blocks 6 are inserted into the housing 14 by translational movement in a vertical insertion direction.

The auxiliary blocks 6 are configured to perform at least one auxiliary function of the switching device 2.

The auxiliary function is for example a signaling function for the state of the switching device 2. In the case where the switching device 2 is a circuit breaker, the auxiliary block 6 is then able to generate an electric state signal representative of the open or closed state of the circuit breaker 2 and to deliver the state signal on the auxiliary terminals 16.

Alternatively, the auxiliary function is a signaling function for a fault trip. In that case, the auxiliary block 6 is able to generate an electric trip signal if the switching block 4 has cut the current I after detecting a fault.

In the example of FIG. 1, the auxiliary blocks 6 are standardized, and each receiving housing 14 is associated with a specific function. In this case, the placement of the auxiliary block 6 in a first housing 14 will give the auxiliary block 6 its first function. For example, the first function is a signaling function for the state of the switching device. Placing the same auxiliary block 6 in a second housing 14 will give the auxiliary block 6 a second function. For example, the second function is a signaling function for a fault trip.

According to another embodiment, not shown, the auxiliary block 6 has its own specific function. For example, each type of auxiliary block 6 has different dimensions from the other types of auxiliary blocks 6.

The trip unit 7 is able to generate a trip signal and deliver it to the switching block 4.

The input terminals 8 are known in themselves. The input terminals 8 are each able to be connected to an input conductor (not shown). The input conductor is able to convey a current I to the input terminals 8.

The input terminals 10 are known in themselves. The input terminals 10 are each able to be connected to an output conductor (not shown). The output conductor is able to convey a current I from the output terminals 10.

The outer enclosure 12 is able to electrically isolate the switching block 4 and the auxiliary blocks 6 from the outside. The outer enclosure 12 is preferably at least partially made from an insulating material. For example, the outer enclosure 12 is made from plastic.

According to the example of FIG. 2, the outer enclosure 12 is parallelepiped. The outer enclosure 12 comprises a base and a cover 36 movable between a closed position and an open position, the base for example including two side plates 32. The cover 36 is able to cooperate with the side plates 32 to close the outer enclosure 12. In other words, the outer enclosure 12 forms a protective casing.

The outer enclosure 12 comprises elements 38 for retaining the cover 36.

In FIG. 1, the outer enclosure 12 also comprises two closing off members 41, for example integral with the side plates 32.

Each receiving housing 14 is configured to receive a respective auxiliary block 6. Each housing 14 includes inner terminals (not shown) able to be electrically connected to the respective auxiliary block 6. The inner terminals are for example able to deliver state information to the corresponding auxiliary block 6.

In the example of FIG. 1, each housing 14 further includes a guide hollow 42 able to cooperate with the corresponding guide rib 28 and fastening elements 44 able to cooperate with the fastening units 30.

Each auxiliary terminal 16 is able to be connected to an auxiliary conductor (not shown) connected to a remote electronic device. The auxiliary terminals 16 are able to deliver an electric signal to the auxiliary conductor. For example, the electric signal is an electric state signal of the switching device. Alternatively, the electric signal is an electric trip signal.

In FIG. 1, the mechanical actuating face 20 bears a button 45 for actuating a contact of the auxiliary block 6.

In the example of FIG. 1, the first end face 22 bears the fastening units 30. The second end face 24 bears the guide rib 28.

The connecting face 26 bears the auxiliary terminal 16. The connecting face 26 is accessible by an operator when the auxiliary block 6 is placed in a corresponding receiving housing 14, and the cover 36 is in the open position. The connecting face 26 is concealed by the cover 36 when the latter is in the closed position.

The guide rib 28 is able to guide the auxiliary block 6 during its placement in the housing 14. The guide rib is for example integral with the second end face 24.

The fastening units 30 are configured to fix the auxiliary block 6 in the corresponding receiving housing 14. For example, the fastening units 30 are elastic snapping units.

The side plates 32 are fixed to one another by a spacer (not shown), and grip the switching block 4.

The cover 36 is movable between an open position, in which the switching block 4 is accessible from the outside, and a closed position, in which the switching block 4 is isolated from the outside of the outer enclosure 12. In particular, the cover 36 is able to provide access to the receiving housings 14 and any auxiliary blocks 6 inserted in the housings 14 when it is in the closed position.

In FIG. 2, the cover 36 is rotatable between an open position and the closed position. The cover 36 includes pivots 46 able to collaborate with the pivot elements 40 of the cover 36. The pivot elements 40 are for example supported by the trip unit 7. The cover 36 includes signaling units 48 movable between an inactive signaling position and an active signaling position. The cover 36 comprises units 50 for keeping the signaling units 48 in the inactive position when the corresponding auxiliary block is missing, and a lug 51 for retaining the signaling units 48.

The cover 36 further includes a control units 52 configured so as, in the presence of at least one auxiliary block in the associated receiving housing 14, to command the movement of each of the signaling units 48 from the inactive position to the active position.

Figure 3:
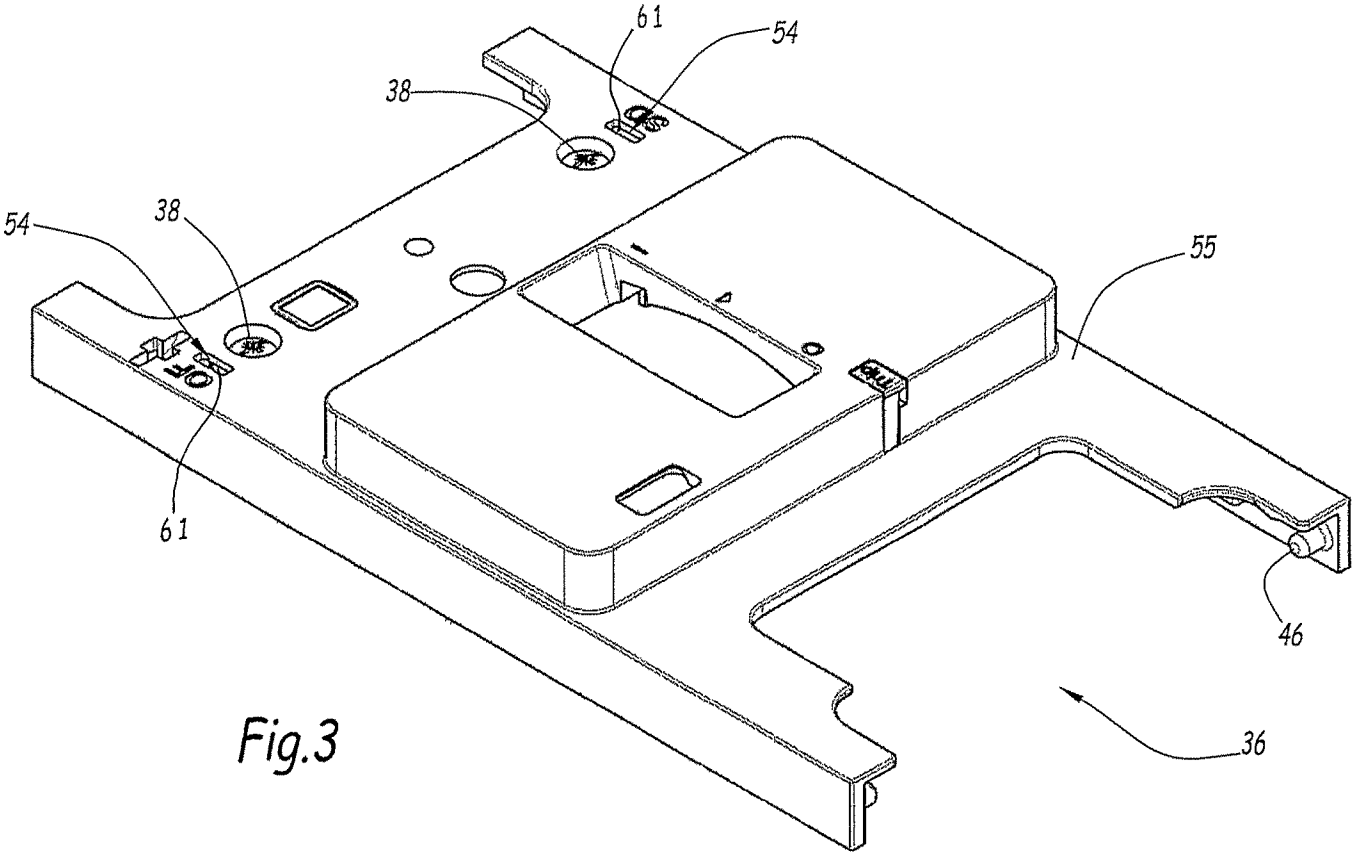
FIG. 3 is a perspective view of the outer face of the cover of FIG. 2, the cover including two signaling members, each movable between an inactive position and an active signaling position indicating the presence of an auxiliary block in the corresponding housing, and each signaling member including a signaling index, each signaling member being in the active position in which the signaling index is visible through the corresponding viewing window.

The cover 36 includes viewing windows 54, shown in FIG. 3. More specifically, the cover 36 includes a viewing window 54 for each receiving housing 14. The cover 36 has an outer face 55 and an inner face 56 designed to come across from the switching block 4 when the cover 36 is in the closed position.

Optionally additionally, the cover 36 is provided with return units (not shown) able to move the signaling elements 48 toward the inactive position when there is no auxiliary block 6. The return members 36 are for example elastic return members, such as springs.

The retaining elements 38 are able to keep the cover 36 in the closed position. In particular, the retaining elements 38 are able to generate a retaining force able to oppose the weight of the cover 36. According to the example of FIGS. 1 and 2, the retaining elements 38 are screws able each to cooperate with a threaded hole 39 of the switching block.

According to FIG. 2, the pivot elements 40 are able to receive the pivots 46 to allow the rotation of the cover 36 between the closed position and at least one open position. The pivot elements 40 are for example hollows formed in the enclosure 12.

The closing off members 41 are positioned so as to be across from the viewing windows 54 when the cover 36 is in the closed position. The closing off members 41 are configured to prevent objects from being inserted through the viewing windows 54 when the cover 36 is in the closed position. In particular, the closing off members 41 are configured so as, when the cover 36 is in the closed position, to prevent the insertion of objects having a section with a diameter larger than 1 mm. In FIG. 1, the closing off members 41 include a planar closing off face 57. The closing off face 57 is substantially parallel to the inner face 56 of the cover 36 when the cover 36 is in the closed position.

The guide hollows 42 are able to guide the auxiliary blocks 6 when they are positioned in their housing 14. Each guide hollow 42 for example includes a groove 58 able to receive the corresponding guide rib 28.

Each fastening element 44 is able to keep the corresponding auxiliary block 6 in position in the corresponding receiving housing 14. According to FIG. 1, each fastener element 30 includes lugs 60 able to collaborate with the elastic fastening units by snapping to prevent the untimely removal of the auxiliary block 6 from the housing 14. The lugs 60 are for example integral with the side plate 32 of the enclosure 12.

The pivots 46 are for example cylindrical projections integral with the cover 36.

The signaling units 48 are translatable in a translation direction between the inactive position and the active signaling position. The translation direction is preferably parallel to the inner face 56 of the cover 36. The translation direction is also preferably parallel to a longitudinal direction of the switching device 2. The longitudinal direction of the switching device 2 is the direction in which the switching device 2 extends, i.e., the direction in which it has its greatest length.

In another embodiment, not shown, the signaling units are rotatable around an axis. For example, the rotation axis of the signaling units 48 is perpendicular to the inner face 56 of the cover 36.

Figure 4:
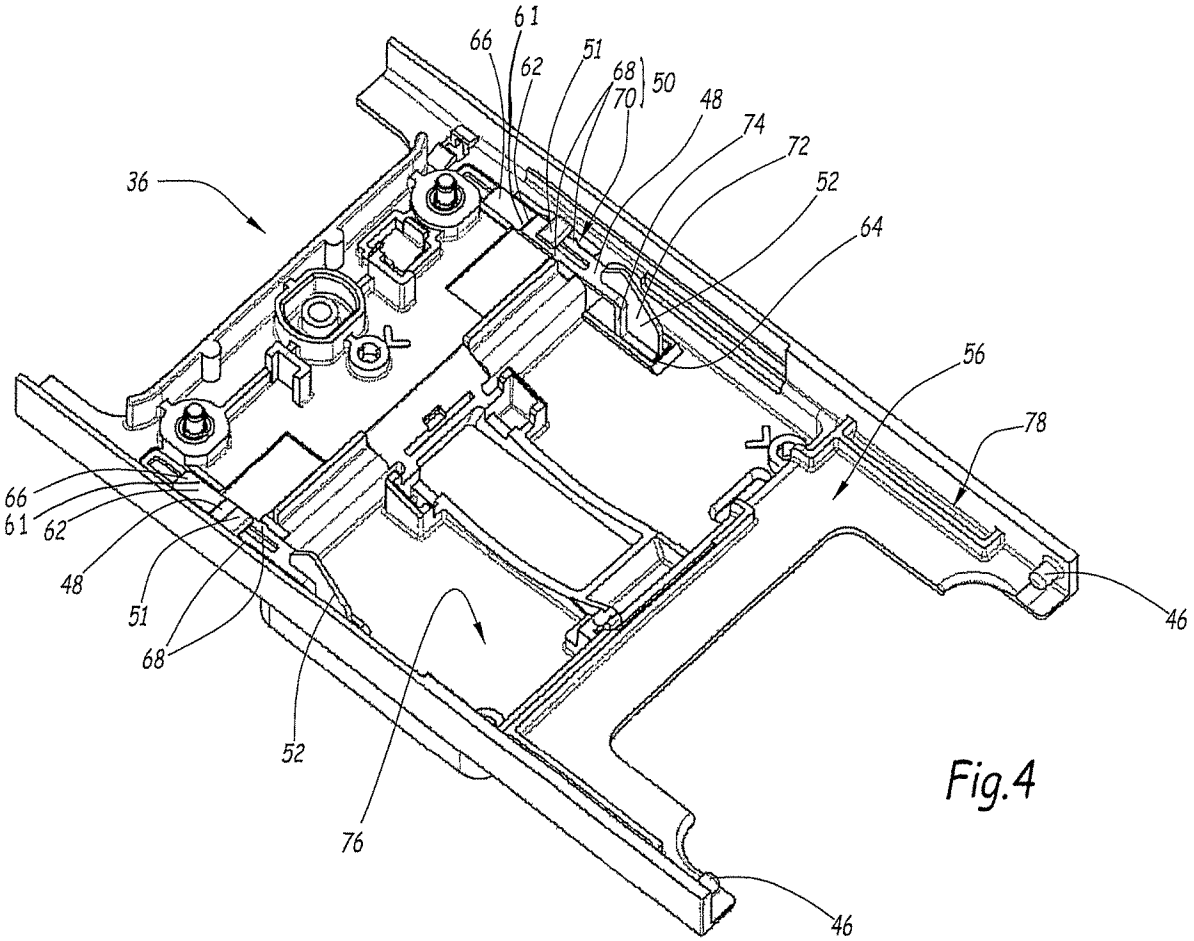
FIG. 4 is a perspective view of the inner face of the cover of FIG. 3, the signaling members being in the active signaling position in which the signaling index is visible through the corresponding viewing window.

The signaling units 48 for example include the signaling members 61 for each receiving housing 14. In the example of FIG. 4, the signaling units 48 then include two signaling members 61. Each signaling member 61 is movable between the inactive signaling position and the active signaling position indicating the presence of a respective auxiliary block 6 in the corresponding receiving housing 14. In an alternative that is not shown, the signaling units 48 are movable between an inactive signaling position and at least two active signaling positions. Each active signaling position for example indicates the presence of a specific type of signaling block 6, the active position then for example varying based on the bulk of the auxiliary block 6, i.e., as a function of its outer dimensions.

In FIGS. 2 and 4, each signaling member 61 is in the shape of a tongue 62 that extends substantially parallel to the inner face 56 of the cover 36 and is able to cooperate with a guideway 64 of the cover. Each signaling member 61 includes at least one signaling index 66. The signaling index 66 is visible through the viewing window 54 when the corresponding signaling members 61 is in its active position.

Figure 5:
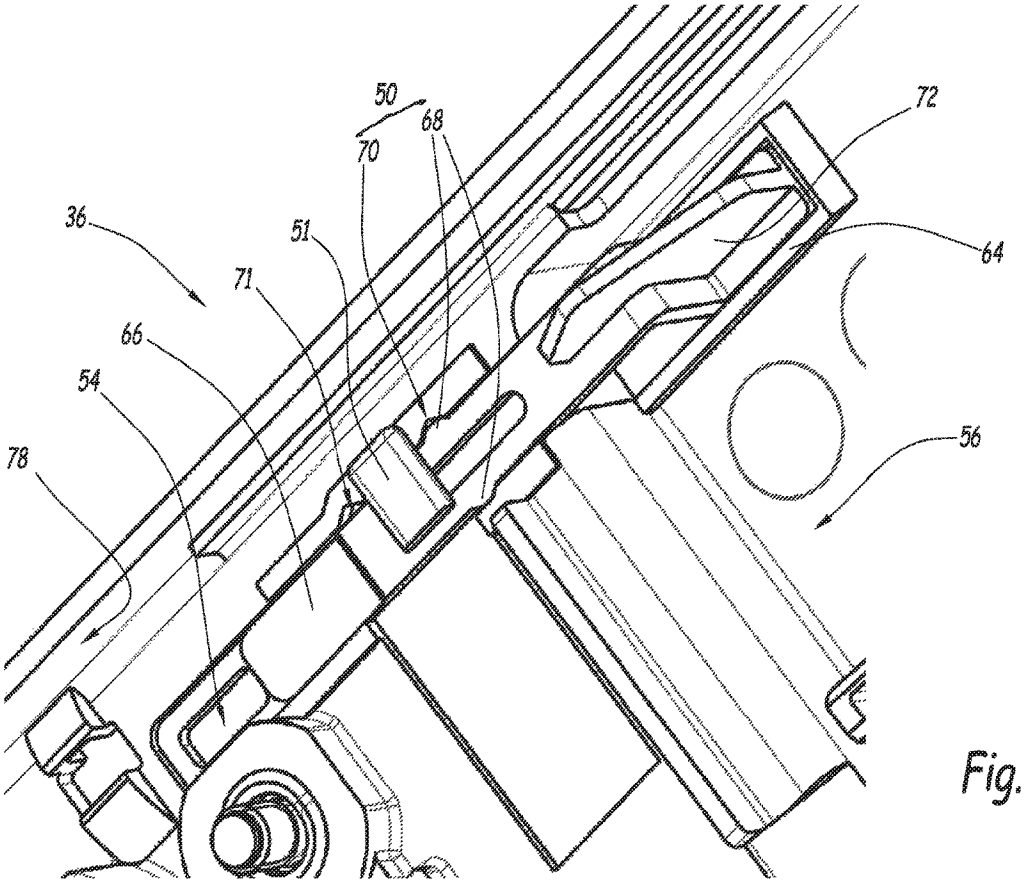
FIG. 5 is a perspective view of the signaling members when they are in the inactive position.

In FIGS. 4 and 5, the maintaining units 50 comprise at least one elastic maintaining protrusion 68, supported by each tongue 62 and at least one retaining cavity 70, better visible in FIG. 5. A second retaining cavity 71 is able to collaborate with the maintaining protrusion 68 to keep the corresponding signaling member 61 in the active position.

Each retaining lug 51 is further able to keep the tongue 62 pressed against the inner face 56 of the cover. Each retaining lug 51 therefore makes it possible to secure the corresponding signaling member 61 and the cover 36. In the described example embodiment, the association of each retaining lug 51 and each guideway 64 prevents the corresponding signaling member 61 from moving other than by translation in the signaling direction.

Figure 6:
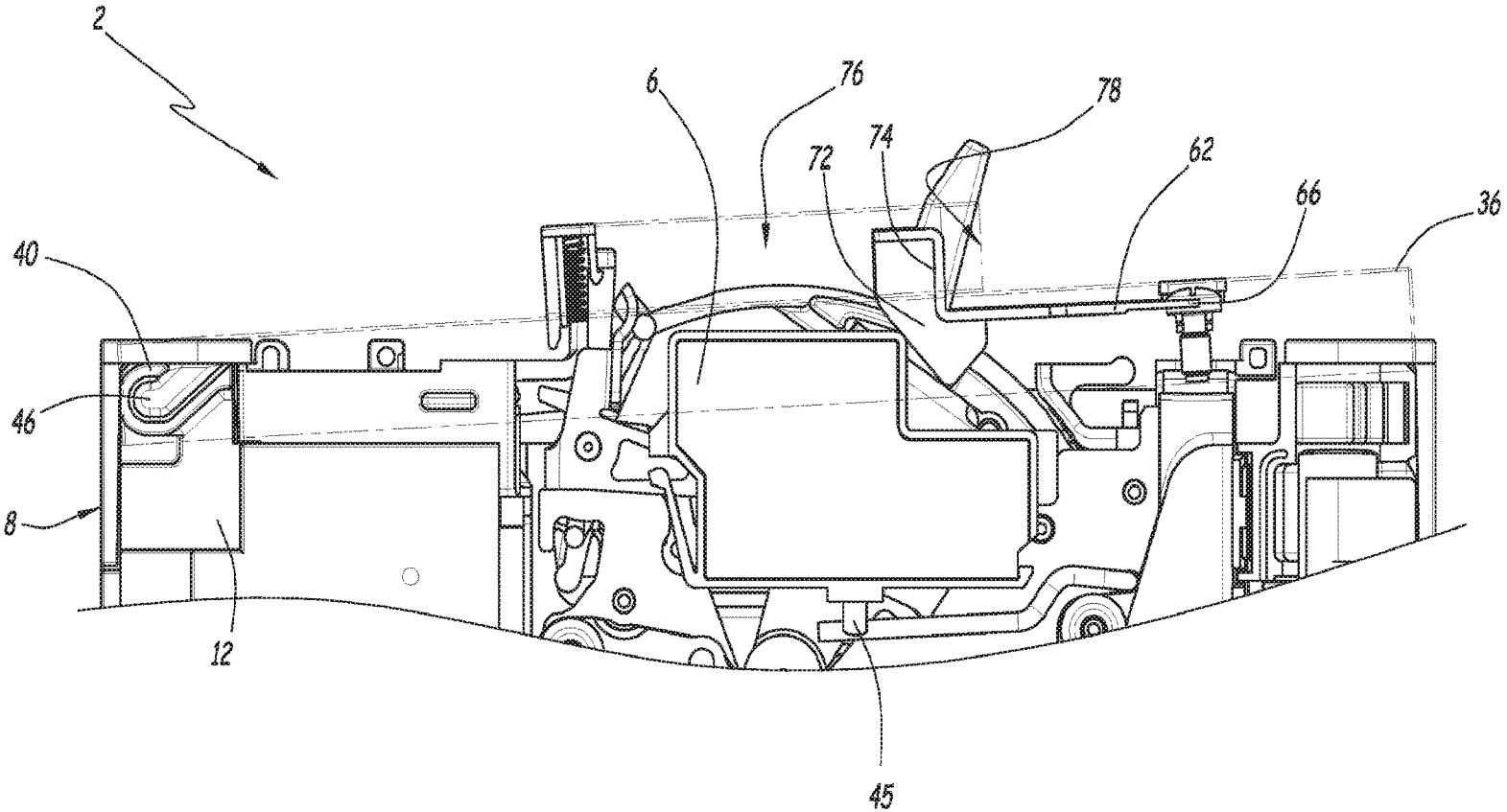
FIG. 6 is a sectional side view of the switching device of FIG. 1 provided with the cover of FIGS. 2 to 4, the signaling units being in the active signaling position.

According to the example of FIG. 6, the control units 52 comprise a cam 72 for each receiving housing 14, each cam 72 being secured to a respective signaling member 61. Each cam 72 is configured to cooperate, during closing of the cover 36, with an auxiliary block 6 present in the associated receiving housing 14 in order to move the corresponding signaling member 61 from the inactive position to the active position.

The control units 52 further comprise a stop 74. The control units 52 are for example integral with the tongue 62.

In the event several types of auxiliary blocks 6 (with different or identical dimensions) are inserted into the housing 14, the control units 52 are able to collaborate with each auxiliary block 6 to move the signaling units 48 into a corresponding active signaling position. Each signaling member 61 is for example configured to cooperate with a respective auxiliary block 6.

The windows 54 are for example in the form of through openings arranged in the cover 36. Optionally additionally, the windows 54 comprise a transparent part (not shown) configured to close off the corresponding opening while allowing an operator to distinguish the viewing index 66 when the signaling units are in the active signaling position.

The inner face 56 of the cover 36 includes a parallelepiped cavity 76 provided with four inner faces 78.

The tongue 62 is configured to be interposed between the closing off face 57 and the window 54 of the cover when the corresponding signaling member 61 is in its active position. The tongue 62 is configured to be inserted between the retaining lugs 51 and the inner face 56 of the cover 36. The tongue 62 is in contact with the inner face 56 of the cover 36. The tongue 62 bears the signaling index 66.

In an alternative that is not shown, the tongue 62 comprises a plurality of signaling indexes 66. Each signaling index 66 corresponds to an active signaling position. Each viewing index 66 is visible through the viewing window 54 when the signaling units 48 are in a corresponding active signaling position.

Each guideway 64 is able to receive a corresponding signaling member 61. Each guideway 64 is able to guide the translation of the corresponding signaling members 61 in the signaling direction between the inactive position and the active signaling position(s).

The signaling index 66 is integral with the tongue 62. The signaling index 66 is visible through the viewing window 54 when the corresponding signaling member 61 is in the active position. The signaling index 66 is not visible through the viewing window 54, and is hidden by the cover 36 from the outside of the switching device 2, when the corresponding signaling member 61 is in the inactive position.

The signaling index 66 is preferably a bright color so that it can be viewed easily through the window 54. If there are several signaling indexes 66 on a same tongue 62, each signaling index 66 is preferably a different color from the other signaling indexes 66 present on the same tongue 62.

Each retaining cavity 70 is able to collaborate by snapping with the maintaining protrusion(s) 68 formed by the corresponding tongue 62 to keep the corresponding signaling member 61 in the inactive position when there is no auxiliary block 6 in the receiving housing 14 associated with said signaling member 61. Each retaining cavity 70 therefore makes it possible to ensure that the corresponding signaling member 61 is not involuntarily moved toward an active signaling position.

The stop 74 is able to collaborate with a corresponding inner face 78 of the cavity 76 to prevent the movement of the corresponding signaling member 61 past a last active signaling position. To that end, the stop 74 includes a stop wall 80 substantially perpendicular to the signaling direction.

Thus, the switching device 2 is able to indicate the presence of an auxiliary block 6 and a corresponding receiving housing 14 with no specific effort for the operator. In the example of FIGS. 1 to 5, if the signaling units 48 are in the inactive signaling position during closing of the cover 36, each cam 72 bears against each auxiliary block 6, as visible in FIG. 6. Each cam 72 then drives the translation of the corresponding signaling member 61 from its inactive position toward its active signaling position, in which the corresponding signaling index 66 is visible through the corresponding viewing window 54.

An outside operator can then easily identify, upon seeing the viewing window(s) 54, whether each corresponding receiving housing 14 does or does not contain an auxiliary block 6.

This signaling is also particularly reliable, since it is not possible, due to the presence of each cam 72, to move the signaling units 48 into the inactive signaling position in the presence of an auxiliary block 6 in a given receiving housing 14.

The switching device 2 is provided, from the factory, preferably with the signaling units 48 in the inactive position.

The maintaining units 50 are further suitable for keeping the signaling units 48 in the inactive position when there is no auxiliary block 6. The maintaining units therefore make it possible to prevent the signaling units 48 from being moved from the active signaling position inadvertently when there is no auxiliary block 6.

Optionally additionally, the cover 36 is provided with elastic return members that are configured to return the signaling units 48 to their inactive signaling position when there is no auxiliary block 6 and/or when there is no action from the control units 52. The return members then create a return of the signaling units 48 to their inactive position, in particular during opening of the outer enclosure 12, this opening causing the cover 36 to move away from the base, the receiving housings 14 and any auxiliary blocks 6.

According to this optional addition, the return members then make it possible to avoid a signaling error in particular if an auxiliary block 6 has been placed in a corresponding receiving housing 14, then has been removed by an operator without the latter thinking to return the associated signaling member 61 to its inactive position.

These return members generally further facilitate the operator's intervention, since he then does not need to act on the signaling member(s) 61, each signaling member 61 automatically being moved toward its active position in the presence of an auxiliary block 6 in the associated receiving housing 14 by the control units 52, and also automatically moved toward its inactive position by the return units, once the control units 52 are no longer actuated, i.e., in particular following the removal of said auxiliary block 6 from the associated receiving housing 14 or after opening of the outer enclosure 12.

In the case where the signaling units 48 comprise a translatable tongue 62, the viewing window 54 is not necessarily situated across from the corresponding auxiliary block 6. This makes it possible for an operator to view the signaling units 48 even if the space across from the housings 14 is concealed by other devices. In other words, each tongue 62 makes it possible to offset, in a zone of the cover 36 that is separate from the corresponding receiving housing 14, the viewing of the presence or absence of an auxiliary block 6 in said receiving housing 14.

It is then possible, depending on the anticipated applications for each type of switching device 2, to adapt the viewing units 48 to offset the viewing window 54 toward the most appropriate zone of the cover 36.

One can then see that the switching device 2 according to the invention allows effective and lasting signaling of the presence of one or more auxiliary blocks 6, while limiting the tasks for which the operator customizing the electrical switching device 2 is responsible and minimizing the risk of human error.

The invention claimed is:

1. An electrical switching device comprising:

an outer enclosure; and at least one receiving housing for receiving a removable auxiliary block, the outer enclosure including a base and a cover, the cover being configured to cooperate with the base to close the outer enclosure, the cover including at least one signaling unit movable between an inactive position and an active position, and at least one control unit configured to move a corresponding signaling unit from the inactive position toward the active position during closing of the outer enclosure when at least one auxiliary block is present in a corresponding receiving housing, each signaling unit including a signaling member, wherein at least one control unit and a corresponding signaling member are monolithic with respect to each other, each signaling member is a tongue, the cover includes an inner face and an outer face that are parallel to each other, the inner face being oriented toward an inside of the outer enclosure, and the tongue being translatable parallel to said inner face along a translation direction, and the at least one control unit including a bearing face angled with respect to the translation direction and bearing against the auxiliary block to move the signaling member to the active position during closing of the outer enclosure.

2. The switching device according to claim 1, wherein the signaling units are translatable relative to the cover.

3. The switching device according to claim 1, wherein the signaling units include a signaling member for each receiving housing, and the control units are configured so as, upon closing of the outer enclosure, to move each signaling member from its inactive position toward its active position when an auxiliary block is present in the receiving housing associated with said signaling member.

4. The switching device according to claim 1, wherein the signaling units include a signaling member for each receiving housing, the control units being configured so as, upon closing of the outer enclosure, to move each signaling member from its inactive position toward its active position when an auxiliary block is present in the receiving housing associated with said signaling member.

5. The switching device according to claim 3, wherein the cover includes a viewing window for each receiving housing, each signaling member being, in its inactive position, invisible from outside the outer enclosure, and in its active position, visible through the viewing window associated with said receiving housing and said signaling member.

6. The switching device according to claim 5, wherein the switching device further comprises a closing off element placed across from each viewing window when the cover is in the closed position, each signaling member being, in its active position, configured to be inserted between the viewing window and the closing off element.

7. The switching device according to claim 1, wherein the switching device comprises at least one removable auxiliary block.

8. The switching device according to claim 7, wherein each auxiliary block is an auxiliary contact.

9. The switching device according to claim 1, wherein the switching device is a circuit breaker.

* * * * *